United States Patent [19]

Nakanishi et al.

[11] Patent Number: 5,015,979

[45] Date of Patent: May 14, 1991

[54] ELECTROMAGNETIC RELAY

[75] Inventors: Yoichi Nakanishi, Kyoto; Junichi Kanetani, Takatsuki; Muneo Nakata, Iida, all of Japan

[73] Assignee: Omron Tateisi Electronics Co., Kyoto, Japan

[21] Appl. No.: 448,272

[22] Filed: Dec. 11, 1989

[30] Foreign Application Priority Data

| | | | |
|---|---|---|---|
| Dec. 15, 1988 | [JP] | Japan | 63-163667[U] |
| Dec. 22, 1988 | [JP] | Japan | 63-165992[U] |
| Dec. 26, 1988 | [JP] | Japan | 63-168945[U] |
| May 16, 1989 | [JP] | Japan | 1-56169[U] |
| May 16, 1989 | [JP] | Japan | 1-56170[U] |
| May 30, 1989 | [JP] | Japan | 1-62726[U] |

[51] Int. Cl.[5] ..... H01H 51/22

[52] U.S. Cl. ..... 335/83; 335/202; 174/52.3

[58] Field of Search ..... 335/202, 78–85, 335/121–124, 128, 52.1; 174/52.2, 52.3

[56] References Cited

U.S. PATENT DOCUMENTS 4,625,191 11/1986 Oberndorfer et al. ..... 335/78

4,740,771 4/1988 Motoyama et al. .

*Primary Examiner*—Leo P. Picard

*Assistant Examiner*—Lincoln Donovan

*Attorney, Agent, or Firm*—Fish & Richardson

[57] ABSTRACT

An electromagnetic relay where a movable stand is retained by a pair of opposing leaf springs, the movable stand is operated in the opposing direction of the leaf spring in accordance with the energization, deenergization of the electromagnet, the movable terminal is disengageably brought into contact against the fixing terminal supported through the support stand, and the movable stand is provided with a through hole in the vertical direction to be press-fitted, mounted in it, a groove in the vertical direction in the contact portion of the movable stand and the leaf spring, and a passage for guiding into the groove portion the bonding agent to be put into the through hole.

10 Claims, 14 Drawing Sheets

ELECTROMAGNETIC RELAY

BACKGROUND OF THE INVENTION

The present invention generally relates to an electromagnetic relay.

Conventionally an electromagnetic relay is proposed in FIG. 18 and FIG. 19. In the electromagnetic relay, a movable block 6 with a movable stand 7 being retained between a pair of leaf springs 8, 8 secured at its one end is operated in accordance with the energization and deenergization of an electromanget block 5 in the opposite directions of the leaf springs 8, 8 (in FIG. 19, arrow mark m, n directions) so as to bring a movable terminal 6*a* into contact againt a stationary terminal 3*a* secured onto the base 1. The movable terminal 6*a* is supported through a support stand 6*a'* on the movable stand 7. The electromagnet block 5 has a yoke 5*c*, a coil terminal (in FIG. 18, the coil is not shown) disposed in a spool 5*b* with an iron core 5*a* being inserted into it.

The electromagnetic relay substantially consists of a base 1, a seal plate 2, terminal blocks 3, 3, a metallic fixture 4 for positioning the one-ends of the leaf springs 8, 8 in the groove portions 1*a*, 1*a* of the base 1, a movable contact piece to be securely press fitted into the movable stand 7, a permanent magnet 6*c* to be grasped by a pair of movable iron pieces 6*b*, 6*b* so as to be securely press fitted into the movable stand 7.

In the electromagnetic relay, the leaf spring 8 is secured onto a projection 7*a* disposed on the side wall of the movable stand 7, and the support stand 6*a'* is press fitted from below into the through hole 7*b*, and secured with a bonding agent The leaf spring 8 and the support stand 6*a'* are respectively secured onto the movable stand 7 by the separate means.

Therefore, there is a problem that the number of assembling jobs of the movable block 6 is more, and the productivity thereof is worse.

Also, since the leaf spring 8 is not secured onto the movable stand 7 with the bonding agent, the adherence property with respect to the movable stand 7 is worse so as to shake the movable stand 7, with a problem that the operating characteristics become unstable.

Also, in the electromagnetic relay, since the leaf spring 8 is made approximately uniform in the sectional shape, it is deformed into a semielliptic shape in accordance with the movement of the movable stand 7. As shown in FIG. 19, the leaf spring 8 on this side moves with the distance S1 from the one end portion 8*a* thereof to the basic portion of the positional projection 7*a* being provided as a distance between the support points when the movable block 6 is operated in the direction of an arrow mark m direction. But when the movable block 6 is restored in the arrow direction n direction, the leaf spring moves with the distance S2 from one end portion 8*a* of the leaf spring 8 to the contact portion 8*b* to come into the angular portion of the movable stand 7 being provided as a distance between the support points, so that the distance between the support points becomes different when the movable block moves in the arrow mark m direction, and when it moves in the arrow mark n direction. Therefore, the spring constant changes, causing unbalance in the spring elasticity of the leaf spring. The same thing can be said about the case of the other leaf spring 8. Thus, the movable block 6 does not move in parallel. Also, the movable block 6 moves in an inclined condition by the twisting of the leaf springs 8, 8, a time lag is caused in the switching operation of a contact because of the uneven contact of the movable contact type 6*a*, with a problem that the operation characteristics of the electromagnetic relay are not good.

Further, such an electromagnetic relay as in the conventional embodiment fixedly crimps the leaf springs 8, 8 onto a pair of positional projctions 7*a*, 7*a* to be projected sidways from both the side faces of the movable stand 7 so as to grasp them. As shown in FIG. 18, when the mobable block 6 is operated in an arrow mark m direction, the leaf spring 8 on this side moves with the distance S1 from one end portion 8*a* thereof to the basic poriton of the positioning projection 7*a* being provided as the distance between the support points. When the movable block 6 is restored into the arrow mark n direction, it moves with the distance S2 from one end portion 8*a* of the leaf spring 8 till the contact portion 8*b* comes into contact against the angular portion of the movable portion 7 being provided as the distance between the support points, so that the distance between the support points in the reciprocating moving operation becomes different ($S1 \neq S2$) even when the distance S3 between the terminals 8*a*, 8*a* is equal to the distance S4 between the contact portions 8*b*, 8*b*. Therefore, the spring constant of the leaf spring 8 changes so as to cause the unbalance in the spring force. The same thing can be said about the case of the other leaf spring 8. As a result, the movable block 6 does not move in parallel, but moves in an inclined condition. Since the time lag is caused in the switching operation of the contact with the movable contact piece 6*a* being uneven in contact, a problem is provided in that the operation characteristics of the electromagnetic relay are not good.

Also, such an electromagnetic relay as in the covnentional embodiment secures the leaf springs 8, 8 through the thermal crimping onto a pair of positional porjections 7*a*, 7*a* to be projected sideways from both the side faces of the movable stand 7 so as to grasp them, so that the mounting direction and the moving direction are the same. Therefore, as the fixing strength in the moving direction is low, the leaf springs 8, 8 are likely to be separated from the moving stand 7.

Further, since the leaf springs 8, 8 are likely to be floated in the thermal crimping operation, and are often crimped thermally in a condition where they are not adhered on the movable stand 7, the given amount of elastic force is hard to obtain, so that the dispersion may be likely to be caused in the operating characteristics.

Also, as shown in FIG. 18, when the movable block 6 is operated in the arrow mark m direction, the leaf spring 8 moves with the distance S1 from one end portion 8*a* thereof to the basic portion of the positional projection 7*a* being provided as the distance between the support points. When the movable block 6 is restored in an arrow mark n direction, it moves with the distance S2 from one end portion 8*a* of the leaf spring 8 to the contact portion 8*b* to come into cotnact against the angular portion of the movable stand 7 being provided as the distance between the support points, the distance between the support points in the reciprocating movement is different. Thus, the elastic contact varies so as to cause the unbalance in the spring force through the leaf spring 8. The same thing can be said about the case of the other leaf spring 8. As a result, the movable block 6 does not move in parallel, but moves in an inclined condition. Since the time lag is caused in the switching operation of the contact with a movable contact piece *6a* being uneven in contact, the operating characteristics of the electromagnetic relay is not good.

Further, conventionally in the electromagnetic relay, an electromagnet on the base has a through hole communicating from the top face thereof to the bottom face thereof provided in the base, with a projection portion provided from the spool or the like of the electromagnet being engaged into the through hole, and the projection portion being heated, melted for a fixing operation. Namely, the projection portion has both a function as a fixing member and a function as a positioning member.

However, since the projected portion is heated, melted so as to deform the shape thereof, the electromagnet is slid out of the normal position of the base, and the distance between the electromagnet and the other member such as movable member, the contact goes wrong, with a problem that the operation characteristics of the electromagnetic relay are dispersed.

SUMMARY OF THE INVENTION

An object of the present invention is to provide an electromagnetic relay, as a means for solving the above-described conventional problem, wherein a movable stand is retained by a pair of opposing leaf springs, the movable stand is operated in the opposing direction of the leaf spring in accordance with the energization and deenergization of the electromagnet, the movable terminal is disengageably brought into contact against the fixing terminal supported through the support stand, a through hole in the vertical direction of the movable stand through which the support stand is mounted, a groove in the vertical direction is provided in the contact portion of the movable stand and the leaf spring, and a passage for guiding into the groove portion the bonding agent to be put into the through hole.

According to the electromagnetic relay of the present invention, the bonding agent put into the through hole penetrates the periphery of the support stand so as to secure the support stand integrally with the movable stand. Also, the bonding agent passes into the passage and penetrates between the movable stand and the leaf spring, lowering along the groove portion. The bonding agent is spread throughout most of the contact region between the movable stand and the leaf spring so as to increase the adherence performance between them. Accordingly, the bonding agent is put into the through hole to secure the leaf spring and the support stand onto the movable stand at the same time, to reduce the contact mechanism portions provided in parallel on the top face of the base. Also, the movable block is grasped by a pair of opposing parallel leaf springs and moved reciprocatingly in the grasping direction of the leaf spring in accordance with the energization, deenergization of the elctromagnet block so as to drive the contact mechanism portion. The pair of leaf springs are integrated by a coupling member to form a support spring, the end portion on one side of the support spring is secured onto the base, the end portion on the other side thereof is movably supported, and also, the distance from the end portion with one leaf spring being secured from between the one pair of leaf springs to the basic portion of the coupling member of the leaf spring is adapted to be equal to the distance from the end portion with the other leaf spring thereof being secured to the basic portion of the coupling member of the leaf spring. Therefore, according to the present invention, one side of the support spring, composed of two leaf springs which retain the movable block, normally adapted to form a parallelogram. Thus, in the reciprocating movement of the movable block in accordance with the energization, deenergization of the electromagnet block, one side of the pair of leaf springs composes a quadric chain. Since the movable block effects the reciprocating movement in a parallel condition without being tilted, and the movable contact mechanism portions arc provided in parallel on the top face of the base, and also, the movable block is retained by a pair of opposing parallel leaf springs, the movable block is moved reciprocatinglly in the grasping direction of the leaf spring in accordance with the energization, deenergization of the electromagnet block so as to drive the contact mechanism portion. Furthermore, the pair of leaf springs are integrated by a coupling member to form a support spring, wherein the end portion on one side of the support spring is secured onto the base and the end portion on the other side thereof is movably supported. Also, the distance from the end portion of one leaf spring to the basic portion of the coupling member secured between the leaf springs is adapted to be equal to the distance from the basic portion of the coupling member to the end portion of the other leaf spring. Since the movable block effects the reciprocating movement in a parallel condition without being tilted, and the movable contact piece is even an electromagnetic relay with superior operating characteristics, wherein time lag is not caused in the switching operation of the contact, is provided.

Further, in the electromagnetic relay for solving the above-described conventional disadvantage in accordance with the present invention, where a movable block is retained by a pair of opposing leaf springs integrated by the coupling member, the movable block is moved reciprocatingly in the grasping direction of the leaf spring in accordance with the energization, deenergization of the electromagnet block to switch the contact, and a tongue is projected onto the lower side from near the lower end portion of the leaf spring to be located onto the extension line of both the side edge portions of the coupling member, with the tongue being engaged into the engagement hole disposed in the movable block.

Also, the tongue is disposed closer to the inner side than on the extension line of the edge portion of the either side of the coupling member, and also, the lower end portion of the leaf spring to be located between the tongue and the extension line may be externally extended out to have a pawl portion. Therefore, according to the present invention, since the tongue projected onto the lower side from the lower end portion of the leaf spring to be positioned onto the extension line of the either side edge portion of the coupling member is engaged into the engagement hole of the movable block, the mounting direction becomes approximately orthogonal to the moving direction. Thus, if the movable block moves reciprocatingly in the grasping direction of the leaf spring, it is hard for the leaf spring to peel off from the movable block. In the present application, the tongue of the leaf spring is engaged into the engagement hole of the movable stand, so that the thermal crimping operation becomes unnecessary to remove the variation in the operation characteristics which cause the inferior thermal crimping operation. Since the tongue of the leaf spring is disposed on the extension line of the either side edge portion of the coupling member, the leaf spring is bent from the extension line when the movable block is reciprocatingly moved. Thus, the distance between the support points from the end portion of the leaf spring to the basic portion of the coupling member of the leaf spring becomes constant, the spring constant of the leaf spring remains unchanged. Since the spring force of the leaf spring remains unchanged at the operation time and the restoring time, and the movble block reciprocatingly moves in parallel without being tilted, the superior operation characteristics are ensured. The tongue is disposed near the inner side of the extension line thereof, not at the lower end portion of the leaf spring to be positioned on the extension line of the either side edge portion of the coupling member, and the pawl portion is formed with the lower end portion of the leaf spring to be positoned between the extension line and the tongue being externally bent, raised, so that the pawl portion has a function of a rib to restrain the elastic deformation of the leaf spring in the leaf thickness direction. As the leaf spring is bent around the extension line if the tongue is near the inner side of the extension line, the distance between the support points remains unchanged even if the movable block is reciprocatingly moved. As a result, as described hereinbefore, the distance between the support points of the leaf spring becomes constant, thus resulting in unchanged spring constant, so that the mobavle block moves in parallel without beng tilted, with an effect that the superior operation characteristics are obtained.

Also, in the electromagnetic relay for switching the contact in accordance with the energization, deenergization of the electromagnet provided on the base in accordance with the present invention, the base is provided with a restraint portion for restraining the electromagnet to the upper face of the base and a through hole communicating from the upper surface of the base to the lower surface thereof. The electromagnet is provided with a portion restrained to be engaged with the restraint portion, and a projection portion to be freely inserted into the through hole. The portion restrained is engaged with the restraint portion and the projection portion is engaged through the through hole, wherein the lower surface of the projection portion is welded. According to the electromagnetic relay, the electromagnet is set in the normal position of the base through the engagement between the restraint portion and the portion restrained, and secured to the base by welding the projection portion. Namely, the positional restraint and the fixing are effected with separate members. Thus, the electromagnet stays in the normal position without moving on the base if the projection portion is welded. Therefore, the distance between the electromagnet and the other member such as movable member, contact becomes correct to stabilize the operation characteristics of the electromagnetic relay.

Further, in the electromagnetic relay of the present invention, where the sealed walls of the sealed case formed through the pressing operation on the metallic plate is erected near a plurality of contact terminals projected from the upper surface of the base and formed in line in a constant direction, and a movable contact piece which moves toward and away from the contact terminal, the sealed case has a pair of opposing parallel sealed walls, the contact terminal and the movable contact piece are adapted to become parallel to the sealed walls between the sealed walls. Thus, according to the present invention, the bending lines in the pressing processing applied on the metallic plate become two parallel straight lines. Therefore, the bending processing is finished at one time, thus reducing the number of the processing operations in half so as to improve the productivitiy. In addition since the sealed walls to be bent, raised are sufficient in number by one pair, the material may be saved in expenditure as compared with that of the conventional embodiment, with an effect that the yield is better.

BRIEF DESCRIPTION OF THE DRAWINGS

These and other objects and features of the present invention will become apparent from the following description taken in conjunction with the preferred embodiments thereof with reference to the accompanying drawings, in which;

FIG. 1 is an exploded perspective view of the electromagnetic relay;

FIG. 2 is a sectional plan view of the electromagnetic relay;

FIG. 3 is a sectional front view of the electromagnetic relay;

FIG. 4 is a sectional side view of the electromagnetic relay;

FIG. 5 is a sectional plan view of the electromagnetic relay;

FIG. 6 is a bottom view of the electromagnetic relay;

FIG. 7 and FIG. 8 are an expansion view of a sealed case and a schematic plan view showing an engaging condition;

FIG. 9 and FIG. 10 are an expansion view of a sealed case and a schematic plan view showing an engaging condition in the other embodiment of FIG. 7 and FIG. 8;

FIG. 11 and FIG. 12 are exploded perspective views showing an engaging condtion between a support spring and a movable block;

DESCRIPTION OF THE PREFERRED EMBODIMENT

Figure 1:
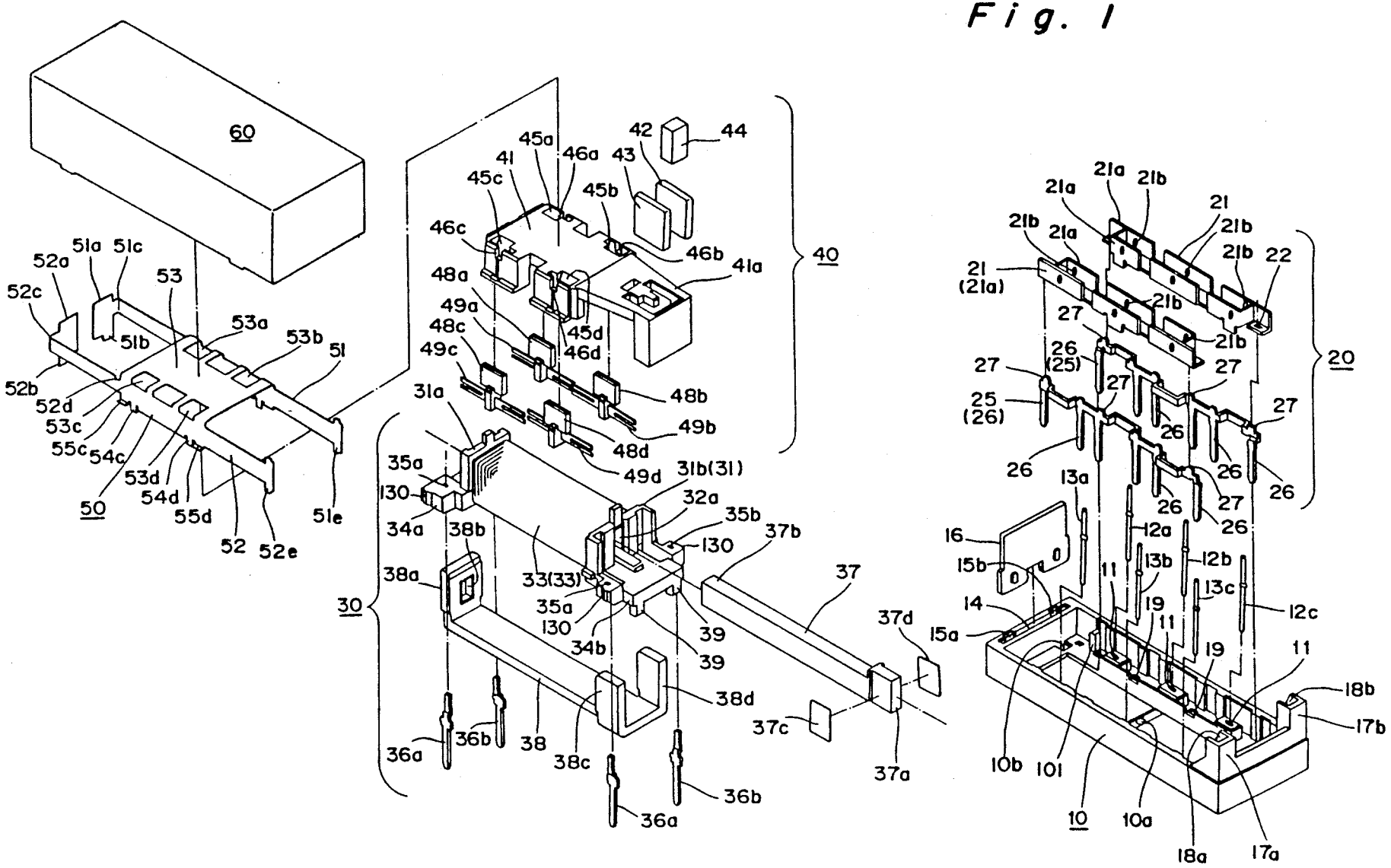
FIG. 1 through FIG. 12 show embodiments of an electromagnetic relay in accordance with the present invention.

Before the description of the present invention proceeds, it is to be noted that like parts are designated by like reference numerals throughout the accompanying drawings.

Referring now to the drawings, there is shown in FIG. 1 through FIG. 7, one embodiment wherein the present invention is applied to a high-frequency relay.

The high-frequency relay substantially consists of a base 10, a sealed mechanism portion 20, an electromagnet block 30, a movable block 40, a support spring 50, and a casing 60. The base 10 is a resin molding having a plurality of terminal holes 11 (the terminal holes on this side in FIG. 1 is not shown) along the long side direction in either side corner portion of the bottom face, with contact terminals 12*a*, 12*b*, 12*c*, 13*a*, 13*b*, 13*c* being respectively press fitted into these terminal holes 11. The four corners of the base 10 have a through hole 10*b* extending from the upper surface to the lower surface (see FIG. 6). A press fitting groove 14 is provided in one side wall on the short side, with a support plate 16 becoming securely press fitted into the press fitting groove 14, and engagement groove portions 15*a*, 15*b* being provided on the rear portion side face of the press fitting groove 14 from the upper end. A pair of strut portions 17*a*, 17*b* are upwardly projected from the angular portions portions on the other side walls on the short side, with retaining grooves 18*a*, 18*b* being respetively provided in these strut portions 17*a*, 17*b*. The side walls in the long side direction are respectively provided with longitudinal ribs 101, 101 in the positions of given distance from the side walls in the short side direction. It is to be noted that reference character 10*a* is a breathing hole.

The sealed mechanism portion 20 is composed of sealded cases 21 and earth terminals 25.

Figure 7:
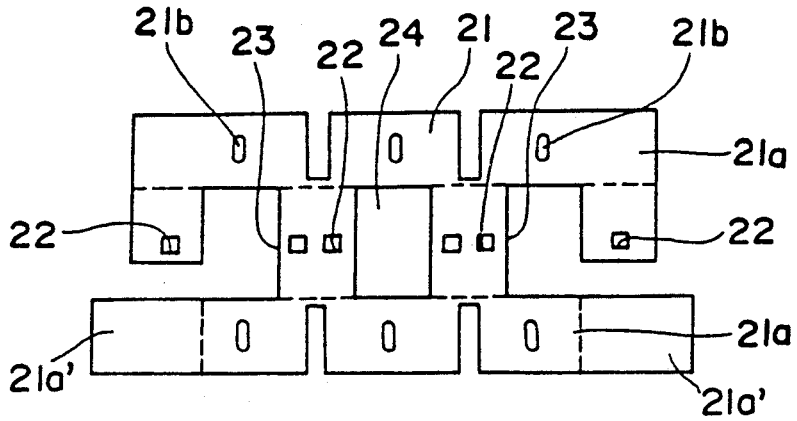

As shown in FIG. 7, the sealed cases 21 have a terminal hole 22, a notch portion 23 and an engagement hole 24 punched out. The metallic plate with a projection 21*b* being projected from it is bent out along a bending line shown in a dotted line by the pressing processing so as to form the sealed walls 21*a*, 21*a*.

The earth terminals 25 have a plurality of continuous terminal portions 26 punched out through the pressing operation, being integrally formed, and bent.

Figure 8:
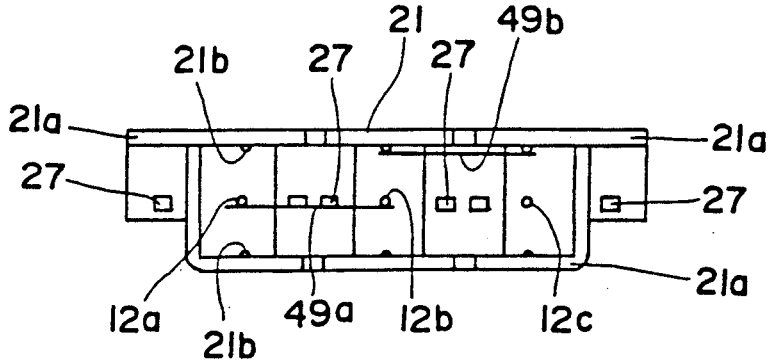

The sealed cases 21 and the earth terminals 25 have the engagement projections 27 of the earth terminals 25 secured into the terminal holes 22 of the sealed cases 21, have the terminal portions 26 respectively press fitted into a plurality of terminal holes 19 (in FIG. 1, the terminal hole on this side is not shown) provided in the bottom face of the base 10. The contact terminals 12*a*, 12*b*, 12*c* are projected respectively from the notch potion 23 of the sealed case 21, the engagement hole 24, the notch portion 23. Accordingly, the contact terminals 12*a*, 12*b*, 12*c* are positioned between the sealed walls 21*a*, 21*b*, and magnetically sealed (FIG. 8). The same thing can be said about the contact terminals 13*a*, 13*b*, 13*c*.

It is to be noted that all the contact terminals are in non-contact condition with the sealed case 21, and are insulated.

Figure 9:
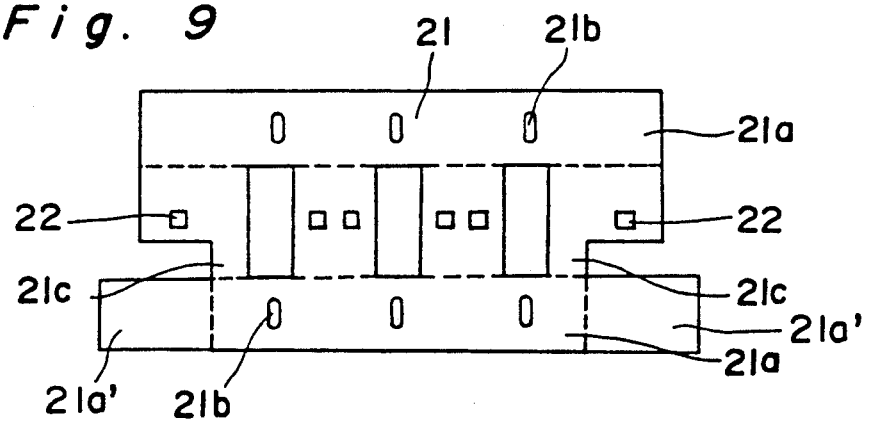
Figure 10:
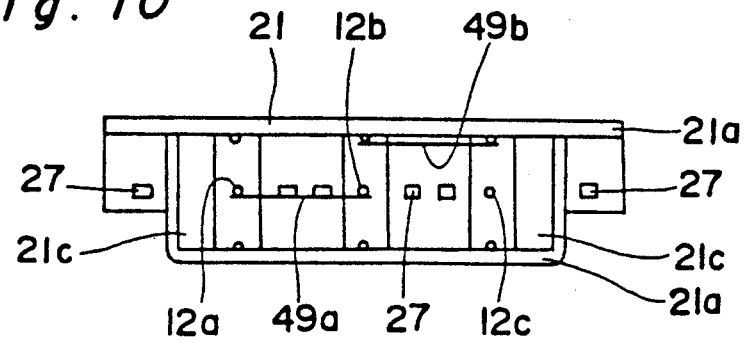

The sealed case 21 is not restricted to one described hereinabove, and may be provided with a coupling portion 21*c* as shown in, for example, FIG. 9, FIG. 10. In accordance with the embodiment, there is an advantage that the mechanical strength of the sealed case 21 is improved, with the size precision of the parts being higher. Since the contact terminals 12*a*, 12*b*, 12*c*, 13*a*, 13*b*, 13*c* are magnetically sealed with a sealed case 21 made of the metallic plate bent onto the base 10 in the embodiment of FIG. 7, FIG. 8, higher size precision is likely to get as compared with, for example, a case where Cu - Ni metal plating is effected on the inner side of the base 10 to form the sealed layer, thus resulting in lower cost. It is to be noted that both the end portion 21*a*' of the sealed walls 21*a*, 21*a* may be removed as shown in FIG. 14 through FIG. 17.

The electromagnet block 30 has two units of coils 33 (33) wound around the barrel portion 32 of the spool 31 which has collar portions 31*a*, 31*b* at either end thereof. The terminal holes 35*a*, 35*b* are respectively provided in the lateral projection portions 130 (130) of the pedestal portions 34*a*, 34*b* respectively provided on the collar portions 31*a*, 31*b*, with coil terminals 36*a*, 36*b* being respectively press fitted into these terminal holes 35*a*, 35*b*. The two units of coils 33, 33 are welded with the respective outgoing lines wound respectively around two units of coil terminals 36*a*, 36*b*. Further, the spool 31 has an iron core 37 inserted into an angular hole 32*a* provided in the barrel portion 32 thereof, and has a projecting one end portion of the iron core 37 end portion as a magnetic pole portion 37*a*. The projecting other end portion 37*b* is secured into the through hole 38*b* provided in the rear bending out piece 38*a* of the yoke 38 so as to position the magnetic pole portion 37*a* between the front bending out pieces 38*c*, 38*d* of the yoke 38. When necessary, the magnetic screening plates 37*c*, 37*d* may be pasted on the absorption face of the magnetic pole portion 37*a*.

Figure 2:
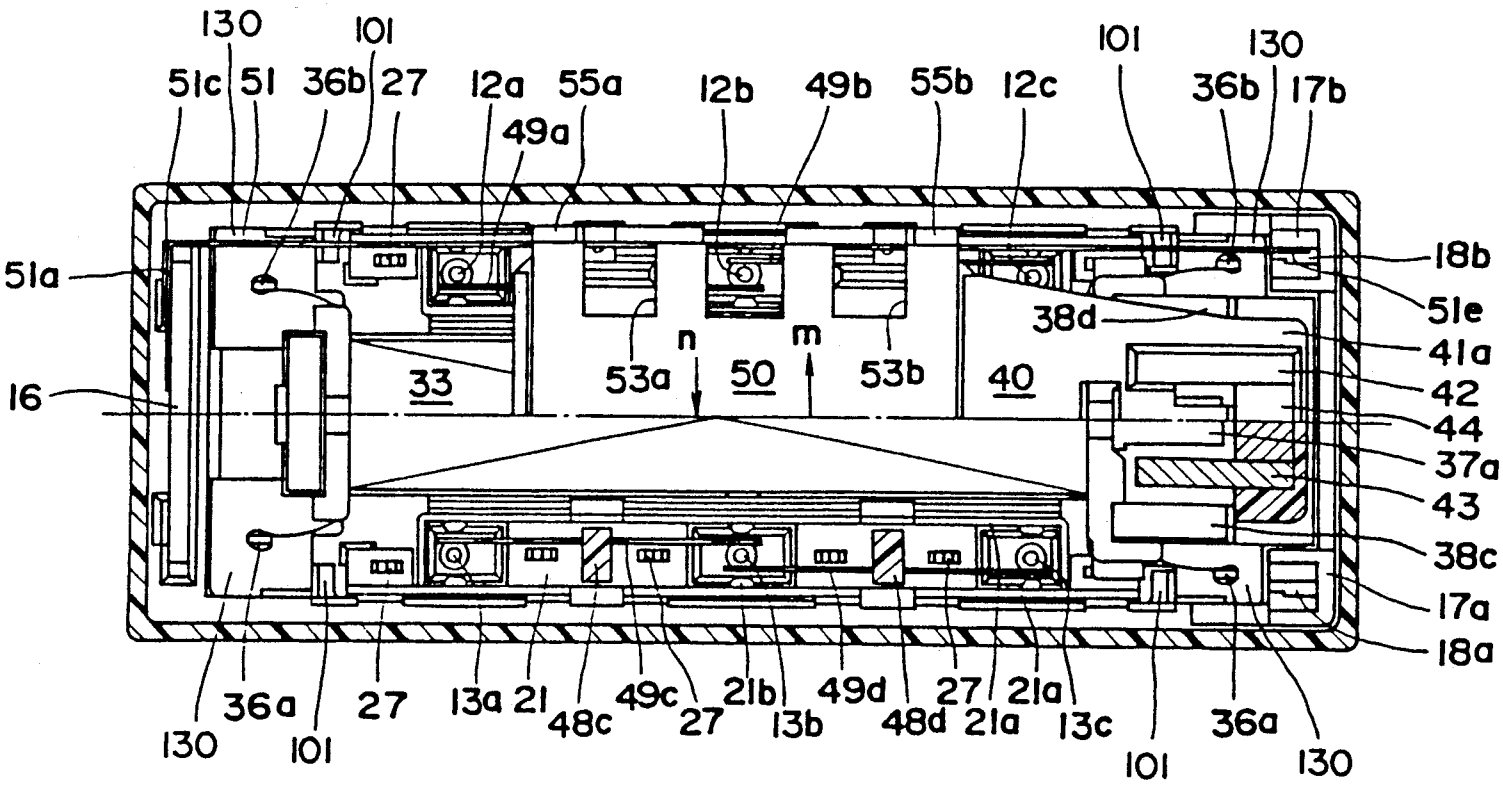
Figure 3:
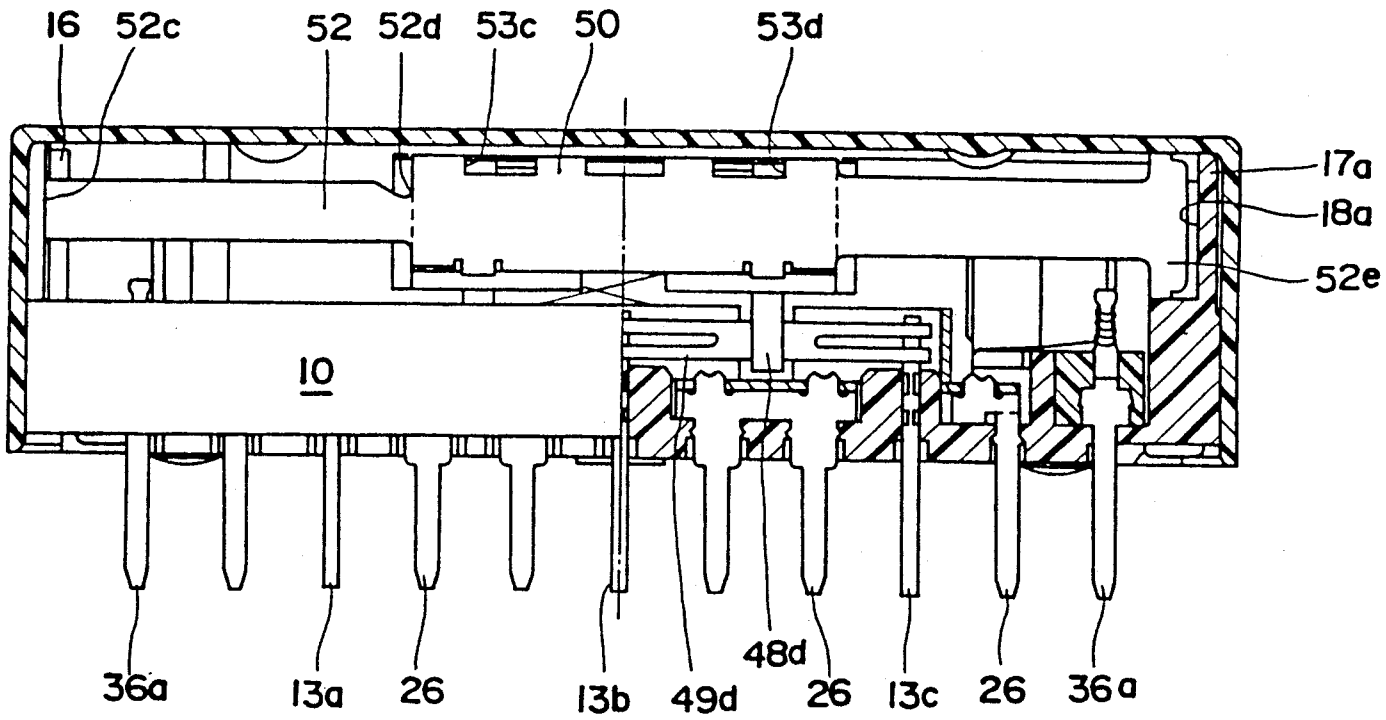
Figure 4:
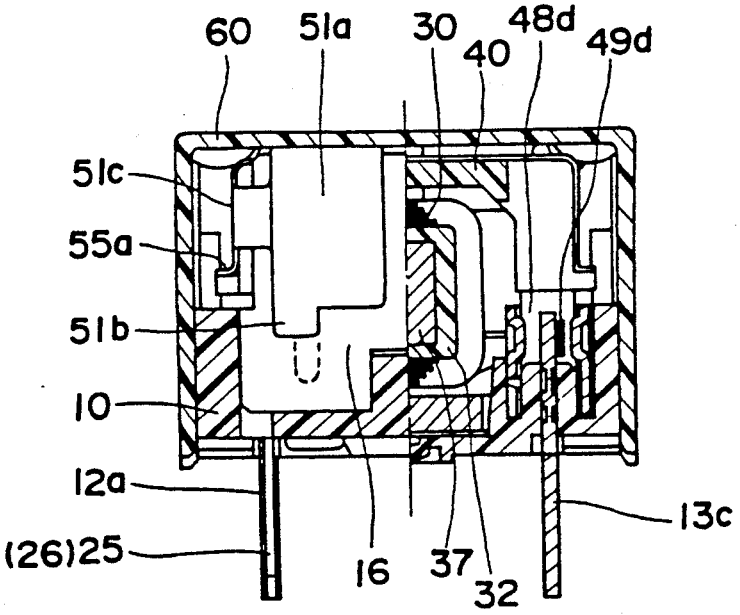

In the above-described construction, as shown in FIG. 2, the lateral projection portion provided on the spool 31 is engaged between the longitudinal rib 101 provided on the base 10 and the base side wall opposite to it, and also, the electromagnet block 30 is positioned on the base 10 with the opposite portions of the lateral projection portions 130 (130) being grasped, pressed against the opposing side walls in the long side direction. Also, a plurality of projections 39 (in FIG. 1, the projection portion on the interior side) to be projected downwardly from the lower surfaces of pedestal portions 34*a*, 34*b* are respectively engaged into a plurality of through holes 100 provided in the bottom face of the base 10, and are secured with the lower surface projection portion thereof being heated, melted. If the projection portion 39 is heated, melted at this time, the electromagnet block 30 does not move as it is positioned with respect to the base 10. Accordingly, the distance between the electromagnet block 30 and the other member becomes precise so as to improve the stability of the operation characteristics.

In the movable block 40, a permanent magnet 44 grasped by a pair of movable iron pieces 42, 43 is press fitted into front frame portion 41*a* of movable stand 41 made of an insulating material, and is secured with a bonding agent, with insulating stands 48*a*, 48*b*, 48*c*, 48*d* being respectively press fitted from below into angular holes 45*a*, 45*b*, 45*c*, 45*d* provided in either side edge portion and being temporarily fastened. The insulating stands 48*a*, 48*b*, 48*c*, 48*d* are respectively provided with movable contact pieces 49*a*, 49*b*, 49*c*, 49*d*, with two rows of parallel movable contact pieces being formed under the movable block 40.

Figure 11:
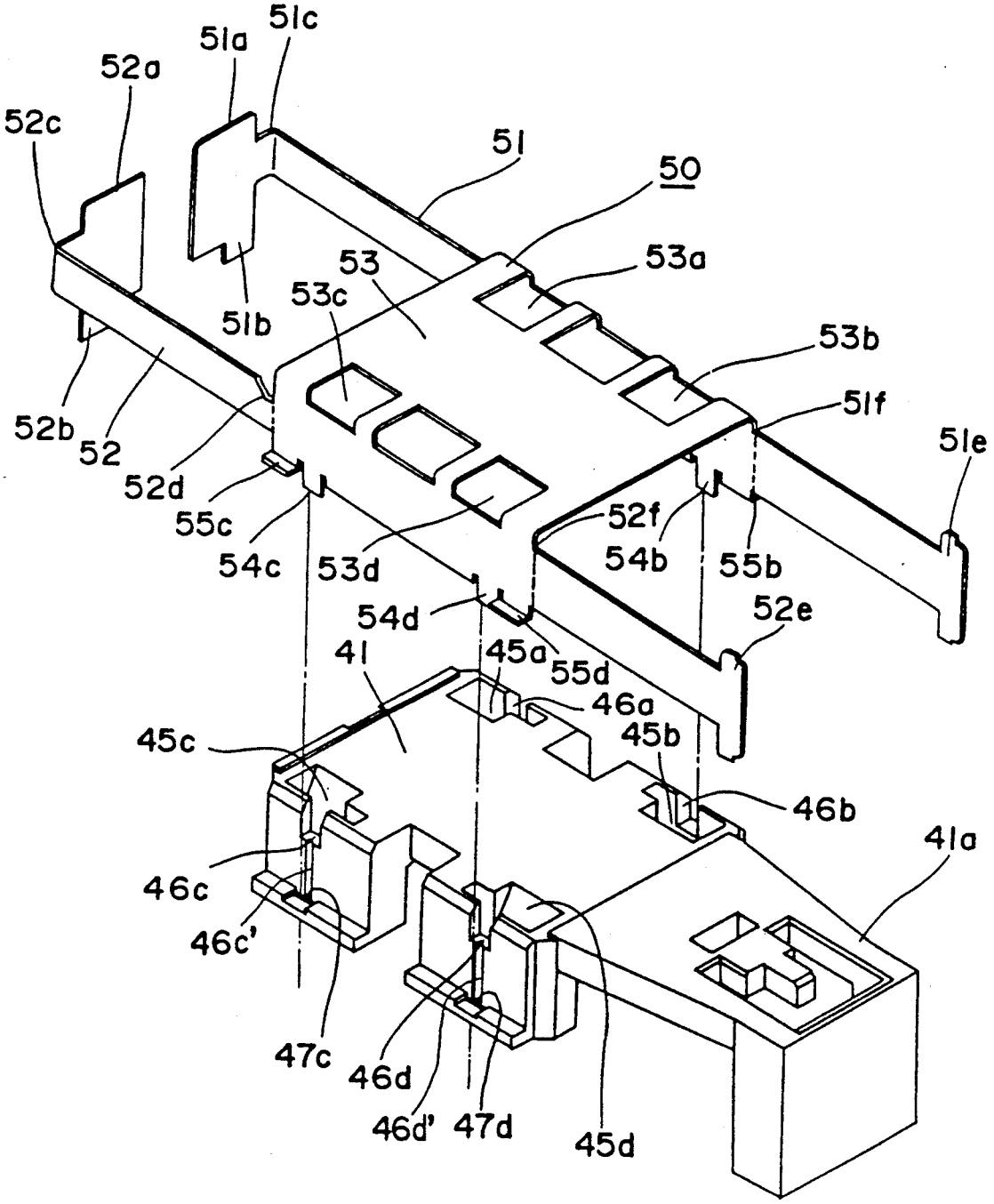

The angular holes 45*a*, 45*b*, 45*c*, 45*d* respectively have gates 46*a*, 46*b*, 46*c*, 46*d*, with these gates 46*a*, 46*b*, 47*c*, 46*d* being connected with engagement holes 47*a*, 47*b*, 47*c*, 47*d* provided under them through grooves 46*a*', 46*b*', 46*c*', 46*d*' (in FIG. 11, the engagement hole and the groove on the interior side are not shown). It is to be noted that the grooves 46*a*', 46*b*', 46*c*', 46*d*' may be removed.

A support spring 50 has two leaf springs 51, 52 disposed in parallel in either side portion of a coupling member 53, so that they are bent, raised so as to be opposed to each other.

The leaf springs 51, 52 are bent inwardly at the rear end portions thereof to respectively form bent portions 51*a*, 52*a*, and also, are provided at leg portions 51*b*, 52*b* at the lower edges of these bent portions 51*a*, 52*a*, with the boundary angular portions among the coupling member 53 and leaf springs 51, 52 being cut out to provide injection holes 53*a*, 53*b*, 53*c*, 53*d* for the bonding agent.

Figure 12:
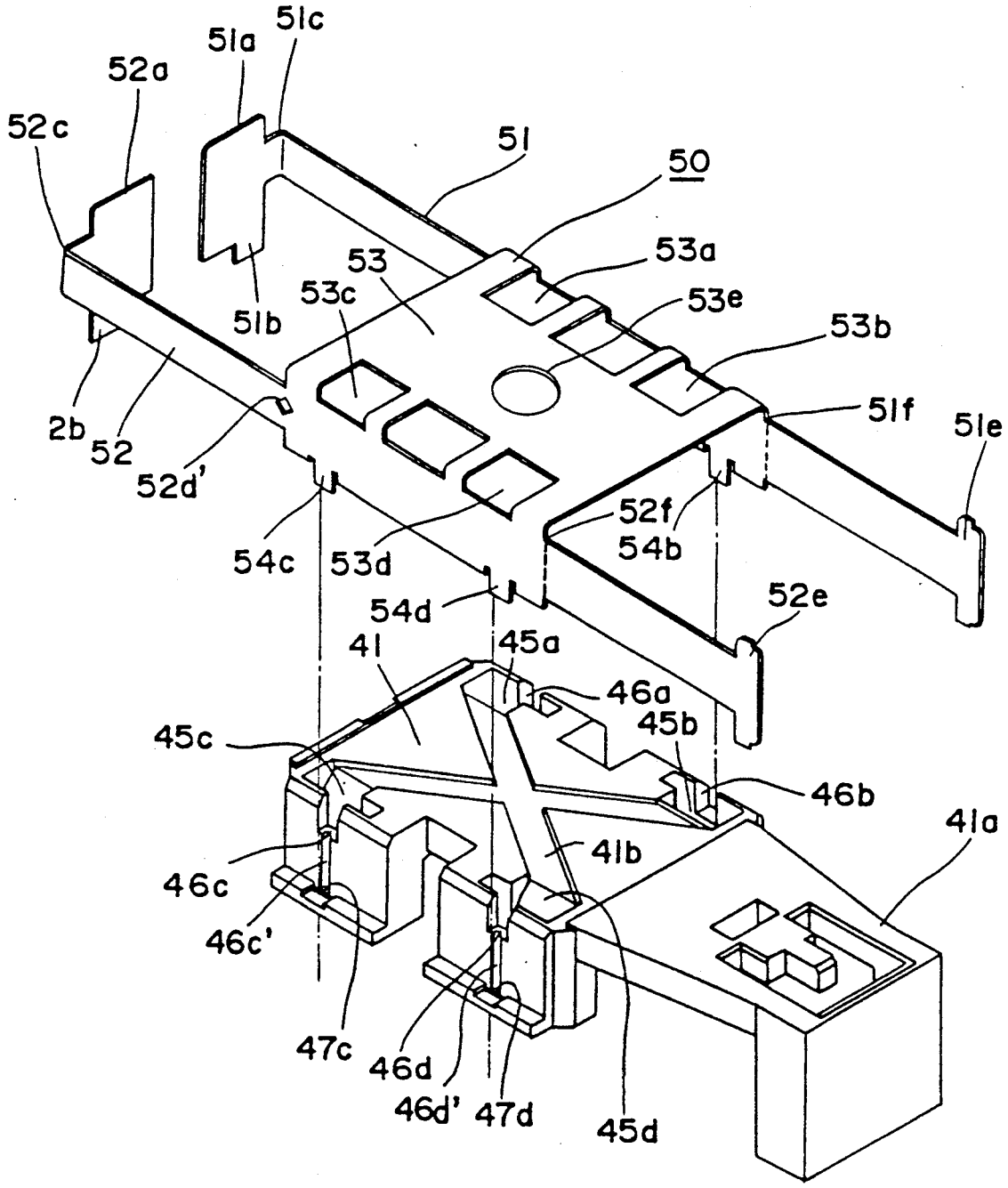

Also, the root portion (hereinafter referred to as "base portion") between the rearwardly extending leaf springs 51, 52 and the coupling member 53 is provided with notch portions 51*d*, 52*d* so as to weaken the bending strength in it. The shape of the notch portions 51*d*, 52*d* is not restricted to that of the present embodiment, but also may be opening-shaped as shown in FIG. 12. In short, the shape has only to reduce the bending strength in the base portion.

Pawl portions 55*a*, 55*b*, 55*c*, 55*d* are projected laterally from the lower end portions of the leaf springs 51, 52 to be positioned in the edge portion of either side of the coupling member 53, and engagement projections 54*a*, 54*b*, 54*c*, 54*d* are respectively projected downwardly (in FIG. 11, the pawl portion, the engagement projection on the interior side are not shown in FIG. 11) from the positions adjacent to them.

Here, the pawl portions 55*a*, 55*b*, 55*c*, 55*d* are not necessarily required As shown in FIG. 12, the pawl portions may be removed.

Figure 13:
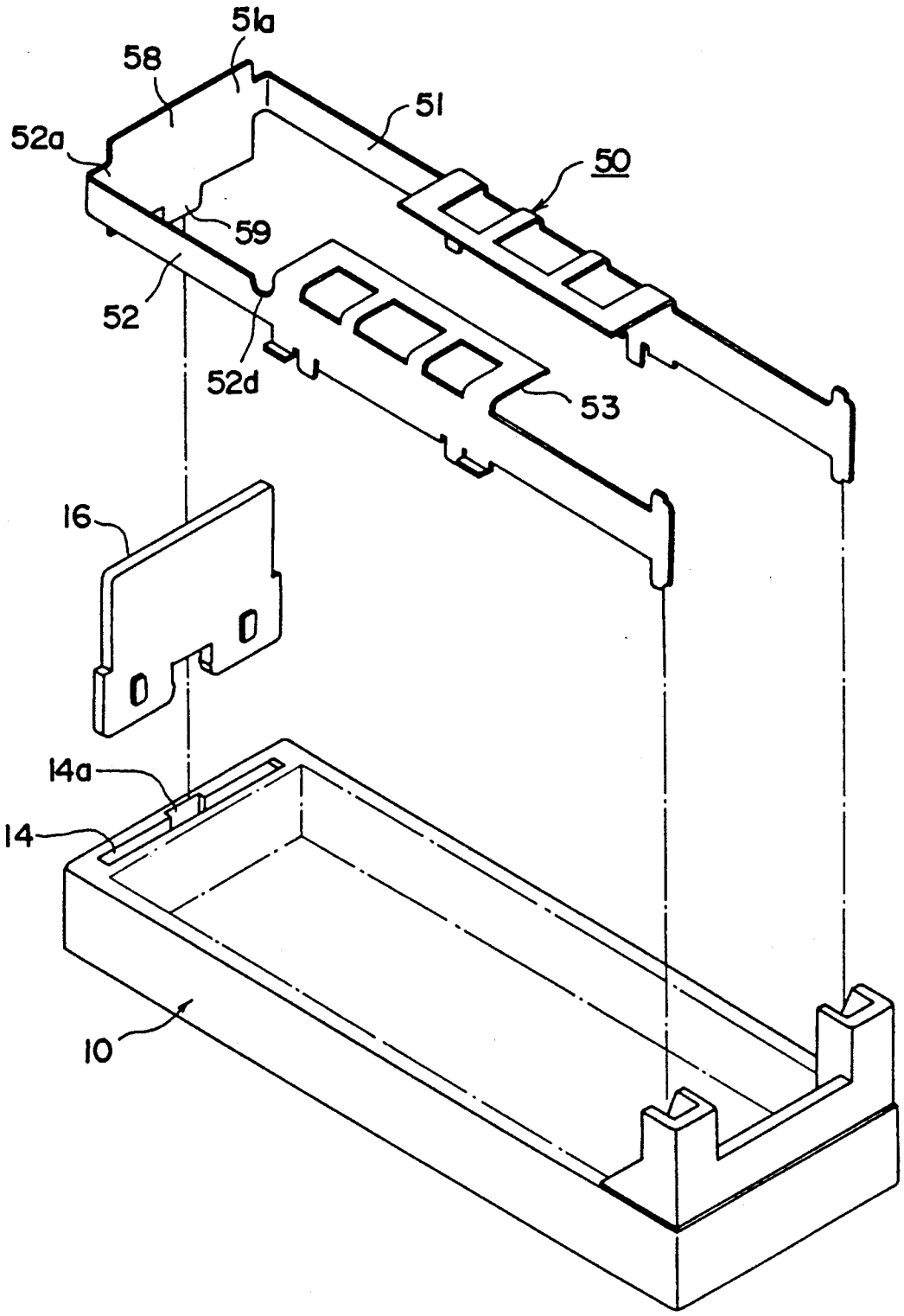
FIG. 13 is a dismantled perspective view showing an engaging condition between the support spring and the movable block in the other embodiment.
Figure 14:
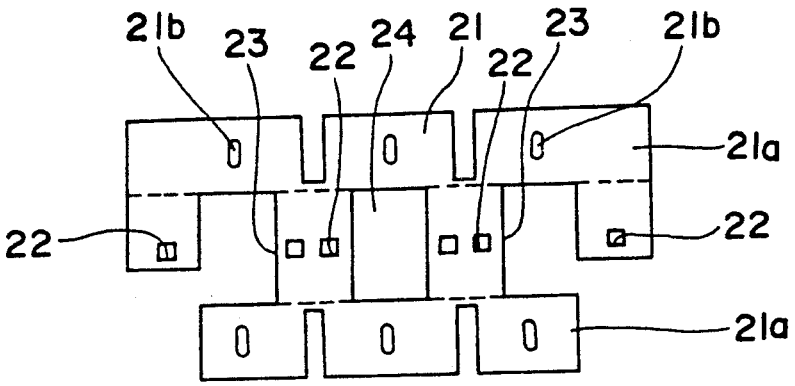
FIG. 14 and FIG. 15 are an expansion view of a sealed case and a schematic plan view showing the other embodiment of the engaging condition.
Figure 15:
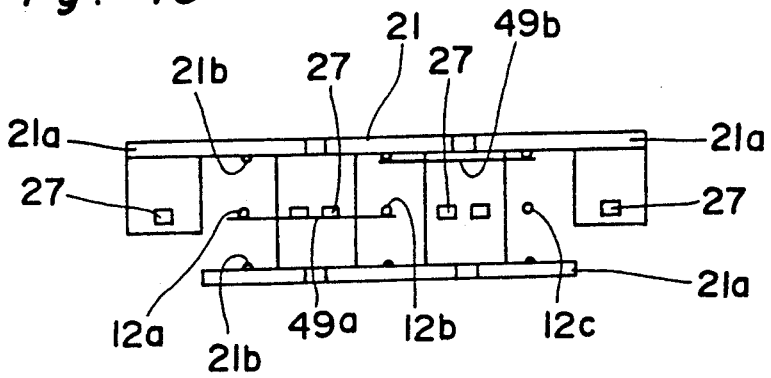
Figure 16:
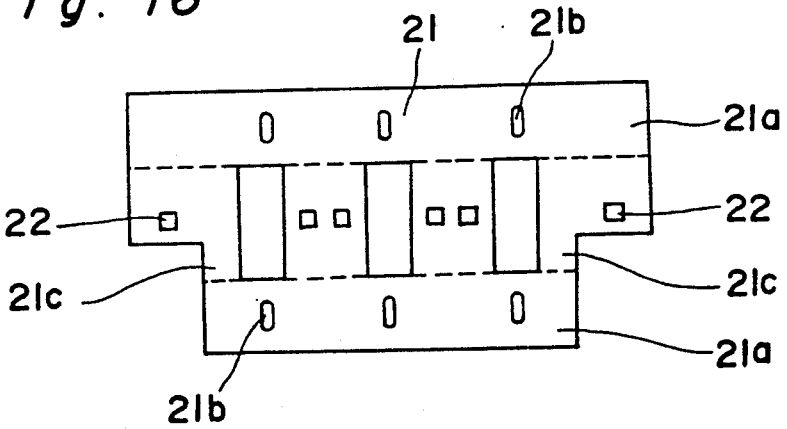
FIG. 16 and FIG. 17 are an expansion view of a sealed case and a schematic plan view showing an engaging condition showing the other embodiment of FIG. 14 and FIG. 15.
Figure 17:
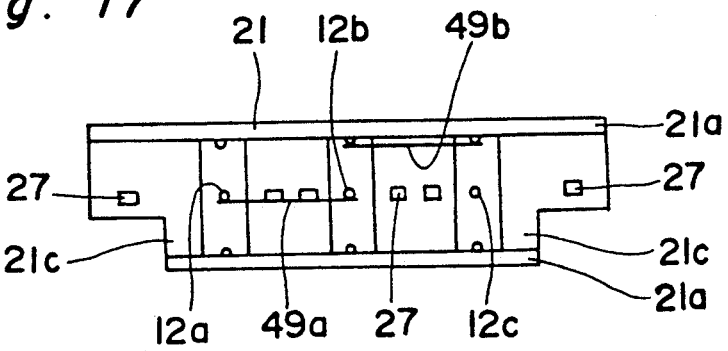

In the present embodiment, two leaf springs 51, 52 are integrated with the coupling member 53. As shown in FIG. 13, the bending portions 51*a*, 51*b* of the respective leaf springs 51, 52 may be coupled by a coupling member 58. In this case, a leg portion 59 is provided on the lower edge of the coupling member 58, and also, an engagement concave portion 14*a* is provided at the center in the press fitting groove 14 of the base 10, so that the leg portion 59 is press fitted into the engagement concave portion 14*a* so as to position the leaf springs 51, 52.

The support spring 50 has a coupling member 53 positioned on the movable stand 41. The engagement projections 54*a*, 54*b*, 54*c*, 54*d* are respectively engaged, positioned into the engagement holes 47*a*, 47*b*, 47*c*, 47*d* of the movable stand 41. The bonding agent is respectively poured into the angular holes 45*a*, 45*b*, 45*c*, 45*d* through the pouring holes 53*a*, 53*b*, 53*c*, 53*d* to secure onto the movable stand 41.

The bonding agent poured into the angular gates 46*a*, 46*b*, 46*c*, 45*e* is penetrated around the insulating stands 48*a*, 48*b*, 48*c*, 48*e* press fitted respectively, and also, the bonding agent overflowed out of the gates 46*a*, 46*b*, 46*c*, 46*e* is penetrated into the gaps with respect to the leaf springs 51*a*, 52, moving downwardly along the grooves 46*a*', 46*b*', 46*c*', 46*e*' so as to simultaneously integrate the movable stand 41, the support spring 50 and the insulating stands 48*a*, 48*b*, 48*c*, 48*e*.

Since the bonding agent penetrated among the leaf springs 51, 52 and the movable stand 41 is spread almost all over the contact regions of both in accordance with the surface tension, the adherence area is more so as to improve the integral property among the leaf springs 51, 52 and the movable stand 41.

As shown in FIG. 12, an injection hole 53*e* is provided in an approximate center of the coupling member 53 and a groove 41*b* communicating with the angular holes 45*a*, 45*b*, 45*c*, 45*d* is provided in the upper surface of the movable stand 41. The bonding agent injected from the injecting hole 53*e* flows into the angular holes 45*a*, 45*b*, 45*c*, 45*d* along the groove 41*b*. Therefore, the injecting operation of the bonding agent is simplified in this manner, because the bonding agent has only to be injected in one place. It is to be noted that the groove 41*b* may be removed.

The movable block 40 with the leaf springs 51, 52 and so on being integrated with the movable stand 41 is arranged on the electromagnet block 30 secured on the base 10. The one-end portions 51*e*, 52*e* of the leaf springs 51, 52 are respectively engaged into the retaining grooves 18*b*, 18*a* of the base 10 to effect the positioning operation in a condition having some play, and the other bending pieces 51*a*, 52*b* are arranged along the rear face of the support plate 16, and also, the leg portions 51*b*, 52*b* are press fitted, engaged into the engagement concave portions 15*a*, 15*b*. The bending pieces 51*a*, 52*a* are secured onto the support plate 16 with spot welding, so that the movable block 40 is supported in a condition where it may be operated in the arrow mark m, n directions of FIG. 2.

Since the space where the spot welding operation is effected is wider to reduce the restriction to be applied upon the position of the electrode, the welding operation may be easily effected.

As the bent pieces 51*a*, 52*a* are spot welded on the support plate 16 in a condition where they are correctly positioned by the base 10 with the leg portions 51*b*, 52*b*, the bent pieces 51*a*, 52*a* of the leaf springs 51, 52 are adhered without being floated from the support plate 16, and are higher in the positional accuracy without any play.

Figure 5:
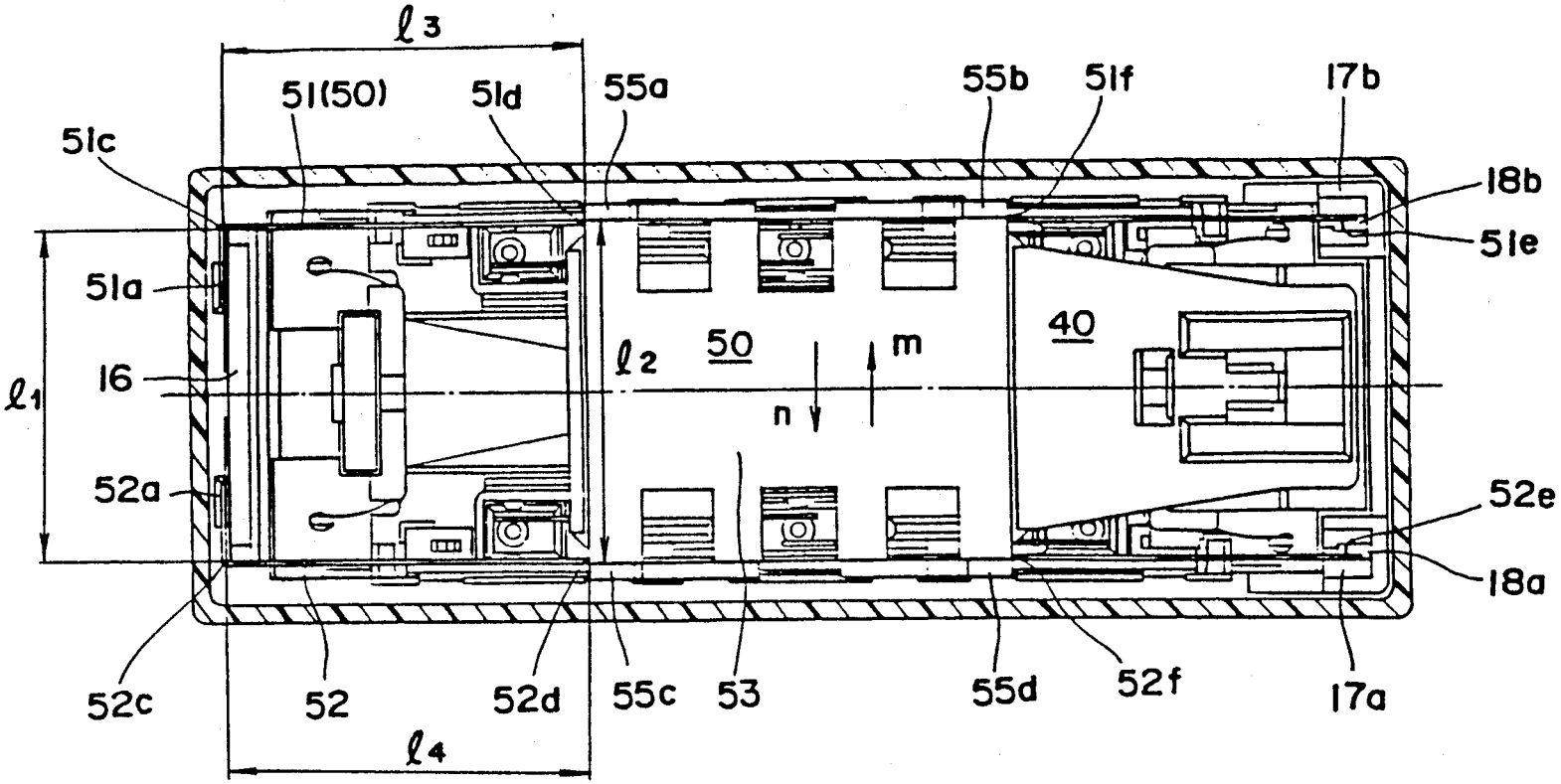
Figure 6:
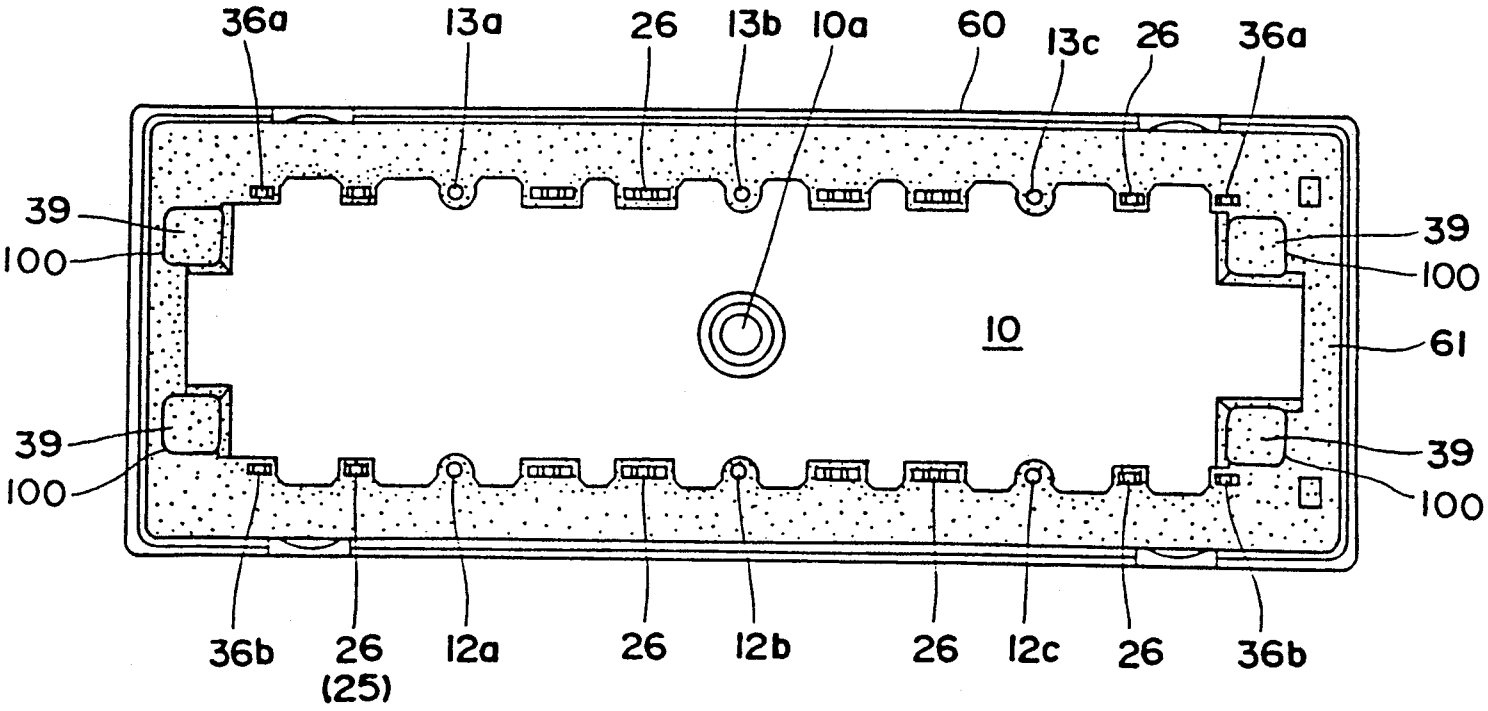

As shown in FIG. 5, the distance l1 between the bent angular portions 51*c*, 52*c* of the leaf springs 51, 52 becomes equal to the distance l2 between the base portions (positions corresponding to the notch portions 51*d*, 52*d*) with respect to the coupling member 53 of the leaf springs 51, 52, and also, the distance l3 from the bent angular portion 51*c* of the leaf spring 51 to the base portion (notch portion 51*d*) becomes equal l4 from the bent angular portion 52*c* of the leaf spring 52 to the base portion (notch 52*d*), so that one side of the support spring 50 normally forms a parallelogram.

Since the bending strength of the notch portions 51*d*, 52*d* is made weak, the leaf springs 51, 52 abruptly bend there to form a shape closer to a parallelogram.

Finally, the casing 60 is engaged with the base 10, the sealing agent 61 is injected, hardened into the bottom face of the base 10, and thereafter is breathed from the breathing hole 10*a* so as to effect a hermetical sealing operation to complete the assembling operation.

By the engagement of the casing 60, the end portions 51*e*, 52*e* of the leaf springs 51, 52 and the movable block 40 are prevented from being floated.

The operation of the high-frequency relay will be hereinafter described.

In a condition where the electromagnet is deenergized, the movable iron piece 42 is adhered on the magnetic pole portion 37*a* of the iron core 37 in accordance with the magnetic force of a permanent magnet 44, with the movable iron piece 43 being adhered on the forward bent out piece 38*c* of the yoke 38. Also, the movable contact piece 49*b* is in contact against the contact terminals 12*b*, 12*c*, while the movable contact piece 49*c* is respectively in respect against the contact terminals 13*a*, 13*b*.

When one of two units of coils 33, 33 is energized so as to cancel the magnetic flux of the permanent magnet 44, the movable iron pieces 42 and 43 repulse respectively to the magnetic pole portion 37*a* of the iron core 37, and the forward bent out piece 38*c* of the yoke 38, and are respectively absorbed onto the forward bent out piece 38*d* of the yoke 38 and the magnetic pole portion 37*a* of the iron core 37, so that the movable block 40 moves in an arrow mark m direction of FIG. 2.

Also, the movable contact piece 49*b* is removed away from the contact terminals 12*b*, 12*c*, the movable contact piece 49*c* is removed away from the contact terminals 13*a*, 13*b*, the movable contact piece 49*a* comes into contact against the contact terminals 12*a*, 12*b*, the movable contact piece 49*d* comes into contact respectively against the contact terminals 13*b*, 13*c*, so that the movable iron pieces 42, 43 respectively adhere on the forward bent out piece 38*d* of the yoke 38, and the magnetic pole portion 37*a* of the iron core 37.

At this time, the bent portions 51*a*, 52*a* of the leaf springs 51, 52 shown in FIG. 5 are secured onto the support plate 16, and the end portions 51*e*, 52*e* are supported movably, the leaf springs 51, 52 are approximately in an uneven condition. As the bent angular portions 51*c*, 52*c* and the base portions 51*d*, 52*d* normally form a parallelogram, the movable block 40 moves in parallel without being inclined. Thus, the movable contact piece 49*a* comes into contact against the contact terminals 12*a*, 12*b*, the movable contact piece 49*d* comes into contact against the contact terminals 13*b*, 13*c* simultaneously without being even in contact, so that the opening, closing characteristics are better.

When the energization into the coil 33 is cut off, the condition thereof is retained by the magnetic force of the permanent magnet 44.

When a current is applied into the other coil 33 so as to form the magnetic field opposite in direction to the above description, the movable iron pieces 42, 43 move in a direction opposite to the above described operation, and are restored into an arrow mark n direction in FIG. 2. Also, the movable contact piece 49*a* is removed away from the contact terminals 12*a*, 12*b*, the movable contact piece 49*d* is removed away from the contact terminals 13*b*, 13*c*, the movable contact piece 49*b* comes into contact against the contact terminals 12*b*, 12*c*, also the movable contact piece 49*c* comes into contact against the contact terminals 13*a*, 13*b* so as to restore into the original condition.

During the operation or during the restoring operation when the movable contact pieces 49*a*, 49*b*, 49*c*, 49*d* are not respectively in contact against the contact terminals, they come into contact against the projection 21*b* of the sealed cases 21, 21 and are magnetically sealed.

Also, in the above-described embodiment, a case where the magnetic pole portion of the iron core as the driving source is one has been described, but it is not always restricted to the above description. It is needless to say that it may be applied to an electromagnetic relay having two driving sources as shown in the conventional embodiment.

Figure 18:
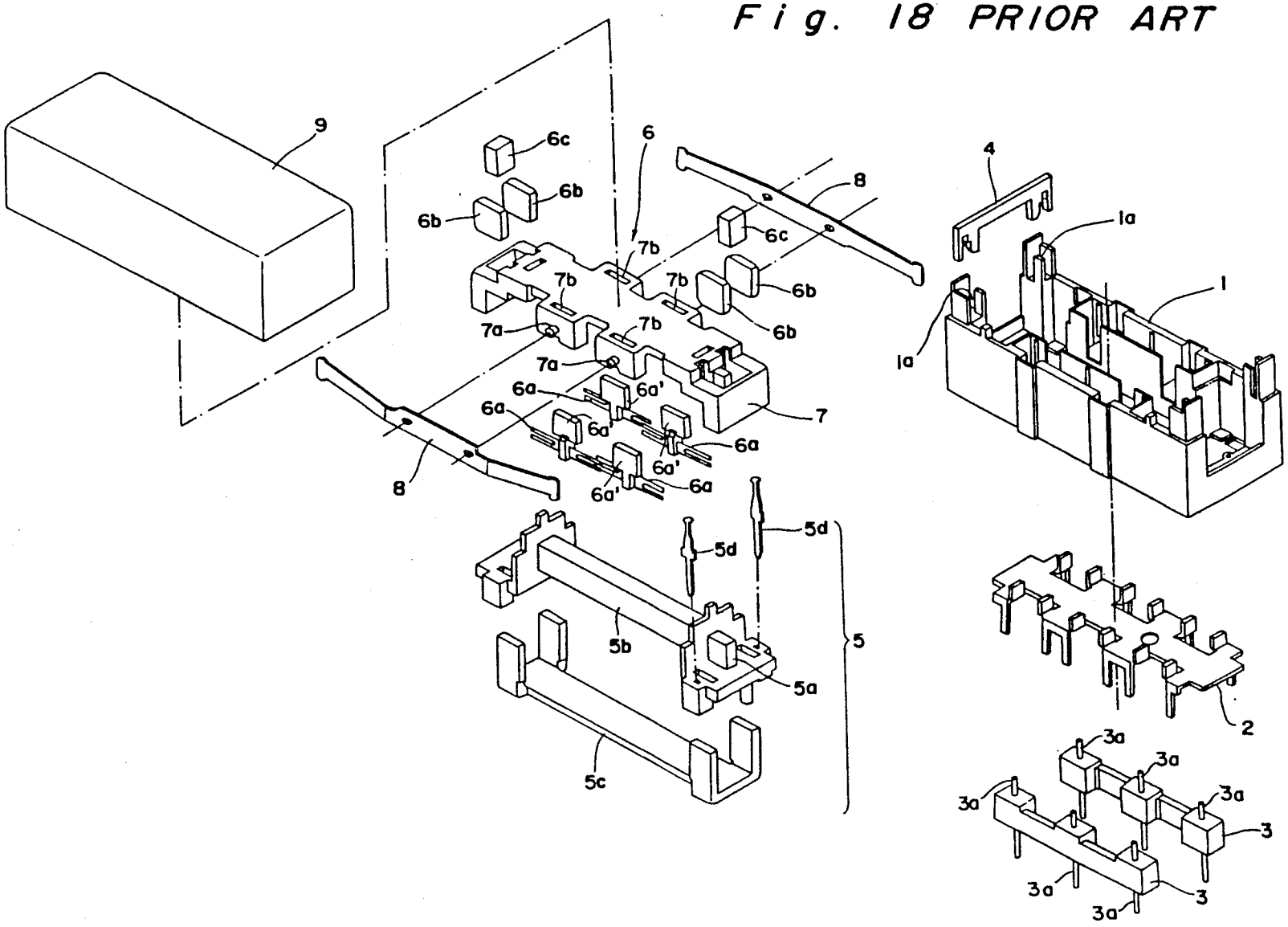
Fig. 18 PRIOR ART
FIG. 18 and FIG. 19 are an exploded perspective view and a sectional plan view of a electromagnetic relay in the conventional embodiment.
Figure 19:
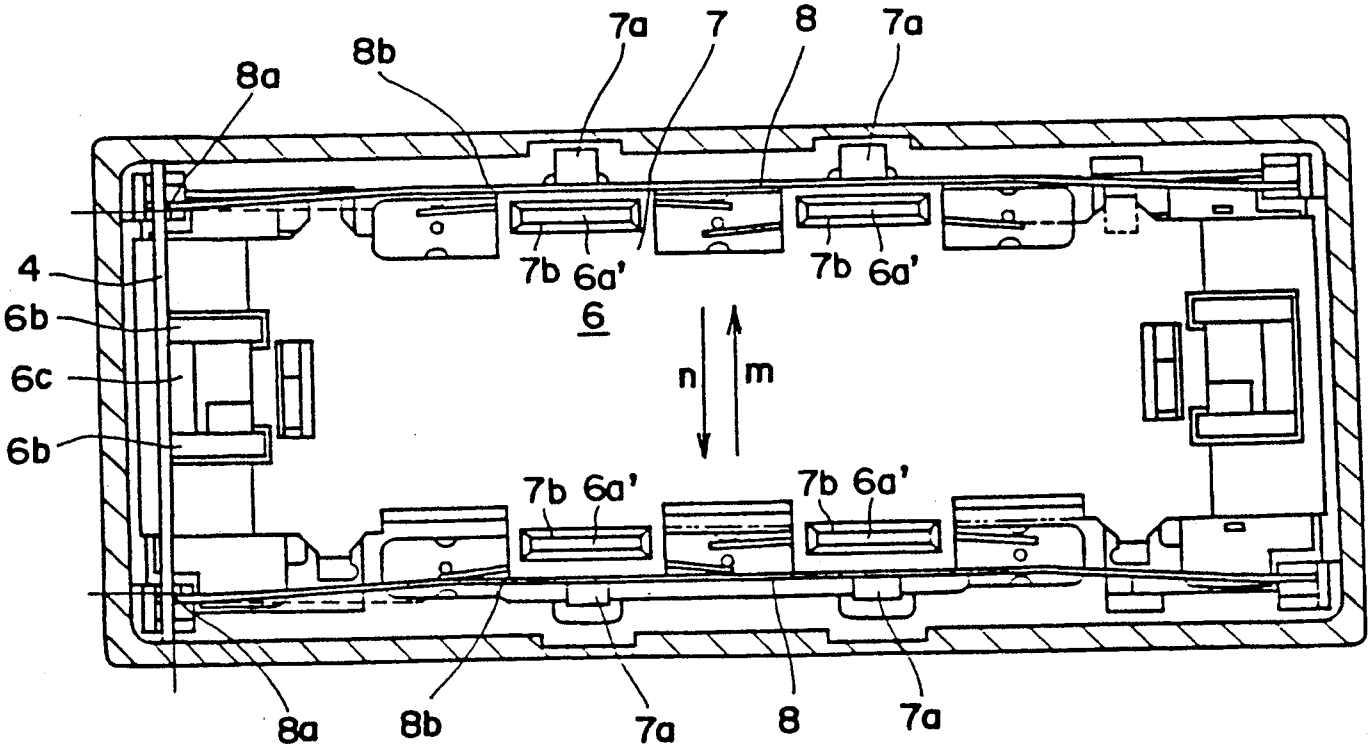
Fig. 19 PRIOR ART
Figure 20:
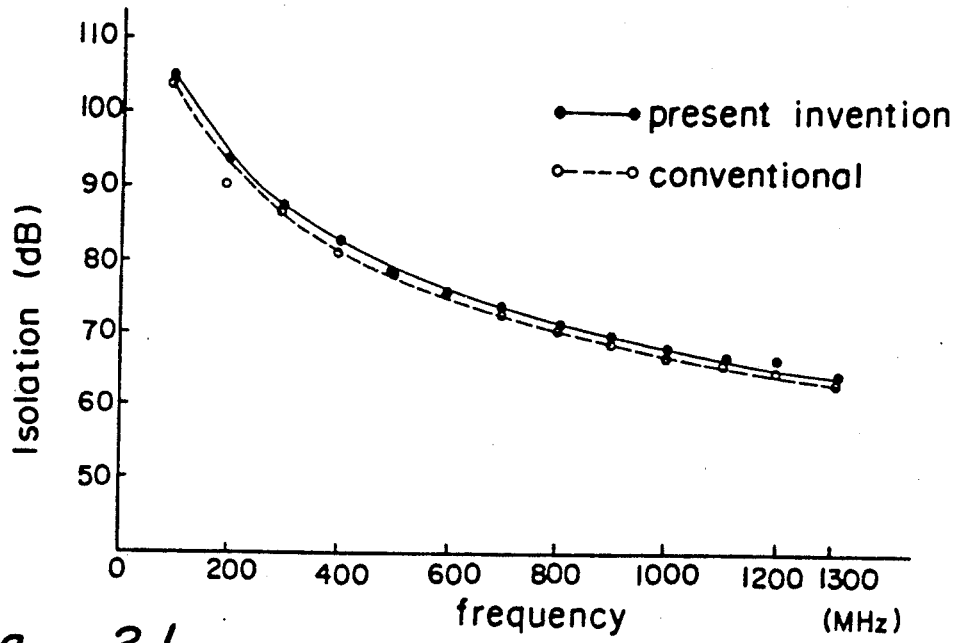
FIG. 20 through FIG. 22 are graph charts showing the frequency characteristics of an electromagnetic relay according to the covnentional embodiment and the present invention.
Figure 21:
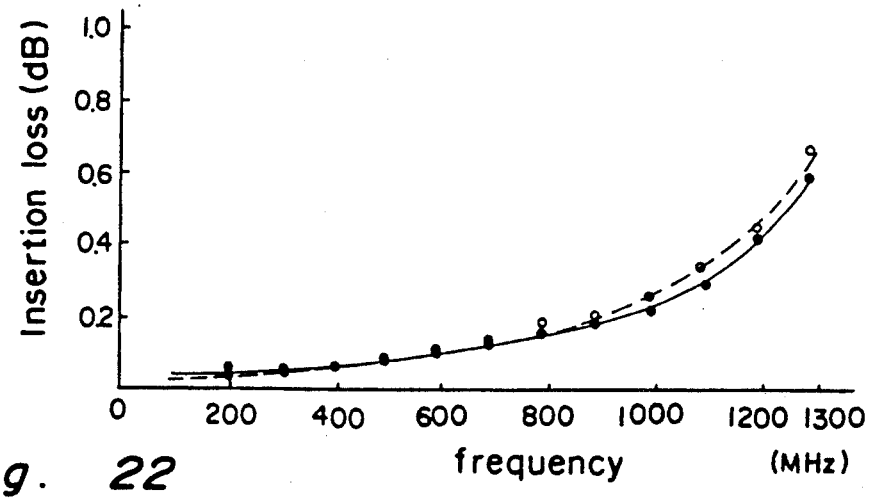
Figure 22:
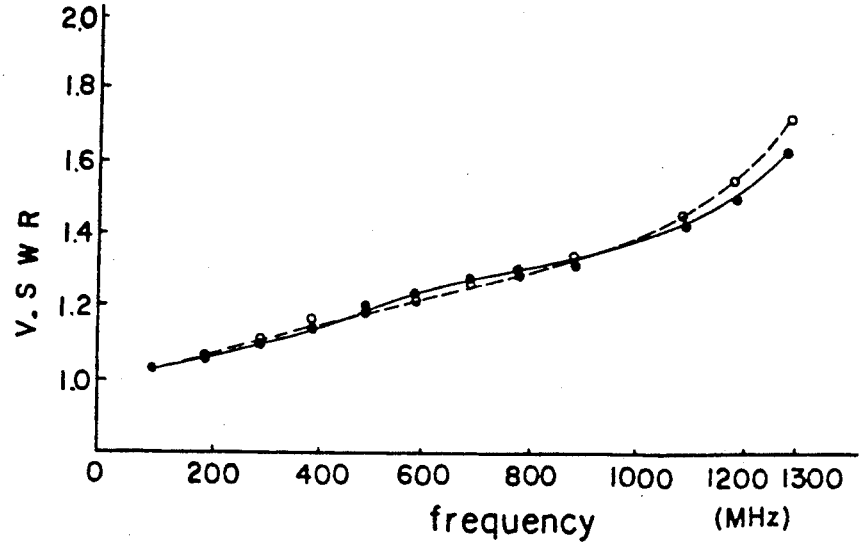

According to the measurement of the frequency chracteristics of the electromagnetic relay in accordance with the present embodiment and the conventional embodiments (FIG. 18, FIG. 19), it has been found out that as shown in FIG. 20 through FIG. 22, these characteristics are not different considerably even in the measurement results of either of isolation, insertion loss and V. SWR, with no problems in practical use.

It has been found out from the above description that simply by the parallel provision of the movable contact piece and the contact terminal in parallel to the sealed walls between one pair of parallel opposing sealed walls, the sealed characteristics are similar to a case where the periphery of movable contact piece and the contact terminal are surrounded by the sealed walls.

Although the present invention has been fully described by way of example with reference to the accompanying drawings, it is to be noted here that various changes and modifications will be apparent to those skilled in the art. Therefore, unless otherwise such changes and modifications depart from the scope of the present invention, they should be construed as included therein.

What is claimed is:

1. An electromagnetic relay, comprising:

a pair of leaf springs coupled by a coupling member;

a movable block, said movable block including a stand mounted between said pair of opposing leaf springs and contacting said pair of opposing leaf springs contact portions, said movable block being movable in a direction perpendicular to the length of the leaf springs in accordance with the energization and deenergization of the electromagnet;

at least one groove formed in said stand, said at least one groove conducting bonding agent to said contact portions; and at least one through hole formed in said coupling member to allow introduction of bonding agent into said at least one groove.

2. An electromagnetic relay as in claim 1, wherein each of said leaf springs includes a pair of downwardly extending engagement projections, each said engagement projection being fitted within a corresponding engagement hole formed in said stand to form said contact portions.

3. An electromagnetic relay as in claim 2, wherein each engagement hole has a corresponding vertical groove for conducting bonding agent to said engagement hole.

4. An electromagnetic relay as in claim 3, further comprising an X-shaped passage for conducting bonding agent from a central through hole to each of said vertical grooves.

5. An electromagnetic relay comprising:

an electromagnet provided on a base for switching a contact in accordance with the energizing and deenergizing operations of the electromagnet, the base having a restraint means for restraining movement of the electromagnet along the upper face of the base and having a through hole communicating from the upper surface of the base to the lower surface thereof, the electromagnet having a portion to be engaged with the restraint means and a projection to be freely inserted into the through hole, so that when the portion is engaged with the restraint means and the projection is inserted into the through hole, the lower surface of the projection is welded on the base.

6. An electromagnetic relay comprising:

a movable stand retained between a pair of opposing leaf springs, said leaf springs being fixed to said stand at one end thereof, the movable stand being movable in a direction perpendicular to the leaf springs in accordance with the energization and deenergization of an electromagnet to switch a contact, and a sectional notch portion provided on the fixed side of the leaf springs near the boundary of contact between the leaf springs and the movable stand.

7. An electromagnet relay comprising:

an electromagnetic block disposed between two units of contact mechanisms provided in parallel on the upper face of a base, said block being retained between a pair of opposing parallel leaf springs and adapted to move reciprocatingly in a direction perpendicular to the leaf springs in accordance with the energization and deenergization of the electromagnet block so as to drive the contact mechanisms, and a coupling member integrated with the one pair of leaf springs to form a support spring, the end portion on one side of the support spring being secured onto the base, the end portion on the other side being movably supported, so that the distance from the end portion with one leaf spring from between the one pair of leaf springs being secured to the base portion of the coupling member of the leaf spring is adapted to be equal to the distance from the end portion with the other leaf spring thereof being secured to the base portion of the coupling member of the leaf spring.

8. An electromagnetic relay, comprising:

a movable block retained by a pair of opposing leaf springs integrated with a coupling member having downwardly extending side edges, said movable block being reciprocatingly movable in a direction perpendicular to the leaf springs in accordance with the energization and deenergization of the electromagnetic block to switch a contact, said movable block having an engagement hole formed therein, and an engagement portion projected from the lower side from near the lower end portion of the leaf spring in a plane parallel to the plane of the side edge portions of the coupling member, with the engagement portion being engaged into said engagement hole.

9. An electromagnetic described in accordance with claim 5, wherein the engagement portion is disposed in a plane parallel to, and between, the plane of each of the side edge portions, and further comprising a pawl portion extending outwardly from the corresponding edge portion adjacent said engagement portion.

10. An electromagnetic relay comprising:

a base, a plurality of contact terminals projecting from the upper surface of the base and formed in a straight line, a sealed case having a pair of opposing parallel walls, the walls of the sealed case being formed by a pressing operation on a metallic plate, so that when assembled, the contact terminals and a movable contact piece are disposed parallel to the walls and are located between the walls.

* * * * *